US005814183A

United States Patent [19]

Miller

[11] Patent Number: 5,814,183

[45] Date of Patent: Sep. 29, 1998

[54] METHOD AND MECHANISM FOR SEALING AN ENVELOPE

[75] Inventor: Carl A. Miller, Fairfield, Conn.

[73] Assignee: Pitney Bowes Inc., Stamford, Conn.

[21] Appl. No.: 55,477

[22] Filed: May 3, 1993

[51] Int. Cl.[6] ..... B43M 3/00

[52] U.S. Cl. ..... 156/442.2; 156/441.5

[58] Field of Search ..... 493/419, 420; 53/429; 270/20.1, 45; 271/2; 156/441.5, 442–442.4, 204

[56] References Cited

U.S. PATENT DOCUMENTS

| | | | |
|---|---|---|---|
| 826,169 | 7/1906 | Jaynes | 156/442.2 |
| 1,437,443 | 12/1922 | Post . | |
| 1,827,589 | 10/1931 | Kleinschmit | 493/420 |
| 3,265,382 | 8/1966 | Sherman | 493/420 |
| 3,416,785 | 12/1968 | Sherman | 493/420 |
| 3,593,486 | 7/1971 | Helm | 53/31 |
| 4,189,895 | 2/1980 | Volkert et al. | 53/429 |
| 4,428,794 | 1/1984 | Hayskar et al. . | |
| 4,609,421 | 9/1986 | Yui . | |
| 4,944,131 | 7/1990 | Gough | 156/441.5 |
| 4,966,353 | 10/1990 | Lehmann et al. | 156/442.1 |
| 5,049,227 | 9/1991 | Long et al. | 156/442.2 |
| 5,183,246 | 2/1993 | Edwards et al. | 270/45 |

FOREIGN PATENT DOCUMENTS

| | | | |
|---|---|---|---|
| 366099 | 12/1906 | France | 156/442.1 |
| 1492812 | 12/1965 | France . | |
| 1503822 | 10/1966 | France . | |

*Primary Examiner*—James Sells

*Attorney, Agent, or Firm*—Robert H. Whisker; Ronald Reichman; Melvin J. Scolnick

[57] ABSTRACT

An envelope is moved along a first path by a first pair of rollers, with the envelope oriented with its lower edge forward, the front panel next to the path, and the flap open. A second pair of rollers is positioned with its nip near the path for capturing the upper edge and flap of the envelope as it clears the first pair of rollers. Preferably the first and second pairs of rollers share a common central roller. A deflector deflects the leading edge of the envelope towards a resilient stop. The stop engages the leading edge of the envelope and urges it back towards the nip of the second pair of rollers. As the upper edge of the envelope clears the nip of the first pair of rollers the force supplied by the first pair of rollers is decoupled from the envelope and force applied by the resilient stop urges the upper edge and flap back towards the nip of the second pair of rollers, which engages the upper edge and folds and seals the flap against the rear panel of the envelope. The deflector is formed of a resilient sheet which deflects in response to contact with the leading edge of the envelope so that the rate at which the envelope is deflected is inversely proportional to the stiffness of the envelope and buckling of the envelope is avoided.

2 Claims, 3 Drawing Sheets

METHOD AND MECHANISM FOR SEALING AN ENVELOPE

BACKGROUND OF THE INVENTION

This invention relates to the sealing of envelopes to form mail pieces. More particularly, it relates to folding and sealing the upper flap of an envelope against the rear panel of the envelope after the contents of the mail piece have been inserted into the envelope.

One method of sealing such envelopes is to drive the filled envelope between a pair of rollers along a horizontal path with the lower edge of the envelope forward and the front panel of the envelope against the path, and then deflect the lower edge of the envelope upwards against a resilient stop. When the crease joining the envelope flap to the body of the envelope clears the nip of the rollers, the force applied by the rollers is effectively decoupled from the envelope and the resilient stop and the force of gravity urge the upper edge of the envelope and the flap into the nip of a second pair of rollers which folds and seals the flap against the rear panel of the envelope.

To avoid buckling the envelope as it is deflected, the deflecting surface is typically curved so the rate at which the lower edge is deflected is limited so that thicker, stiffer envelopes do not buckle. When the upper edge of the envelope clears the nip of the drive rollers and begins to move backwards towards the nip of the folding and sealing rollers the force from the drive rollers is effectively decoupled from the body of the envelope, which tends to straighten out. As it straightens the envelope moves away from the deflecting surface and is thus not guided and supported as the upper edge moves towards the folding and sealing rollers. It is believed by the present inventors that this lack of guidance and support for the body of the envelope is a significant cause of misfeeds and jams in such envelope sealing mechanisms; particularly for thinner, less stiff envelopes.

Thus, it is an object of the subject invention to provide an envelope sealing mechanism and method which is adaptable to a wide range of envelope thicknesses, and stiffnesses, and which functions with a high degree of reliability.

BRIEF SUMMARY OF THE INVENTION

The above objects are achieved and the disadvantages of the prior art are overcome in accordance with the subject invention by means of a mechanism and method for sealing an envelope which includes an apparatus for moving the envelopes along a path, the envelopes being oriented with the lower edge forward and the front panel against the path, and having the envelope flap open. The mechanism also includes a second apparatus for capturing the upper edge of the envelope as it clears the first apparatus and folding and sealing the flap against the rear panel. The second apparatus has an intake for capturing the flap and upper edge of the envelope which is positioned beside and close to the path. The mechanism also includes a resilient stop which engages the lower edge and urges the upper edge towards the intake. The mechanism further includes a deflecting apparatus for deflecting the lower edge from the path towards this stop at a variable rate of deflection, the rate of deflection varying inversely with the stiffness of the envelope to prevent buckling of the envelope.

In accordance with the method of the subject the envelope is oriented on a path which passes close to the intake of an apparatus for folding and sealing the flap of the envelope against the rear panel of the envelope with the front panel of the envelope against the path and the lower edge of the envelope forward, and the flap open. A force is applied to the envelope to move it along a path which passes adjacent to the intake of a mechanism for folding and sealing the flap of the envelope against the rear panel. As the envelope moves along the lower path, the forward edge is deflected towards a resilient stop in a manner such that the rate at which the lower edge is deflected varies inversely with the stiffness of the envelope so that the envelope does not buckle. The resilient stop applies a retrograde force against the lower edge of the envelope, the retrograde force not being sufficiently large to overcome the initial force so that the envelope continues to advance. As the upper edge of the envelope approaches the intake, the initial force ceases, preferably because the force is now applied to the flap which lacks the stiffness to couple a significant force to the envelope. Then under the influence of the retrograde force the upper edge of the envelope moves back and is captured by the folding and sealing apparatus.

Thus, it can be seen that the above objects are achieved and the disadvantages of the prior art are overcome in accordance with the subject invention. Other objects and advantages of the subject invention will be apparent to those skilled in the art from consideration of the detailed description set forth below and the attached drawings.

DETAILED DESCRIPTION OF THE PREFERRED EMBODIMENTS OF THE SUBJECT INVENTION

Figure 1:
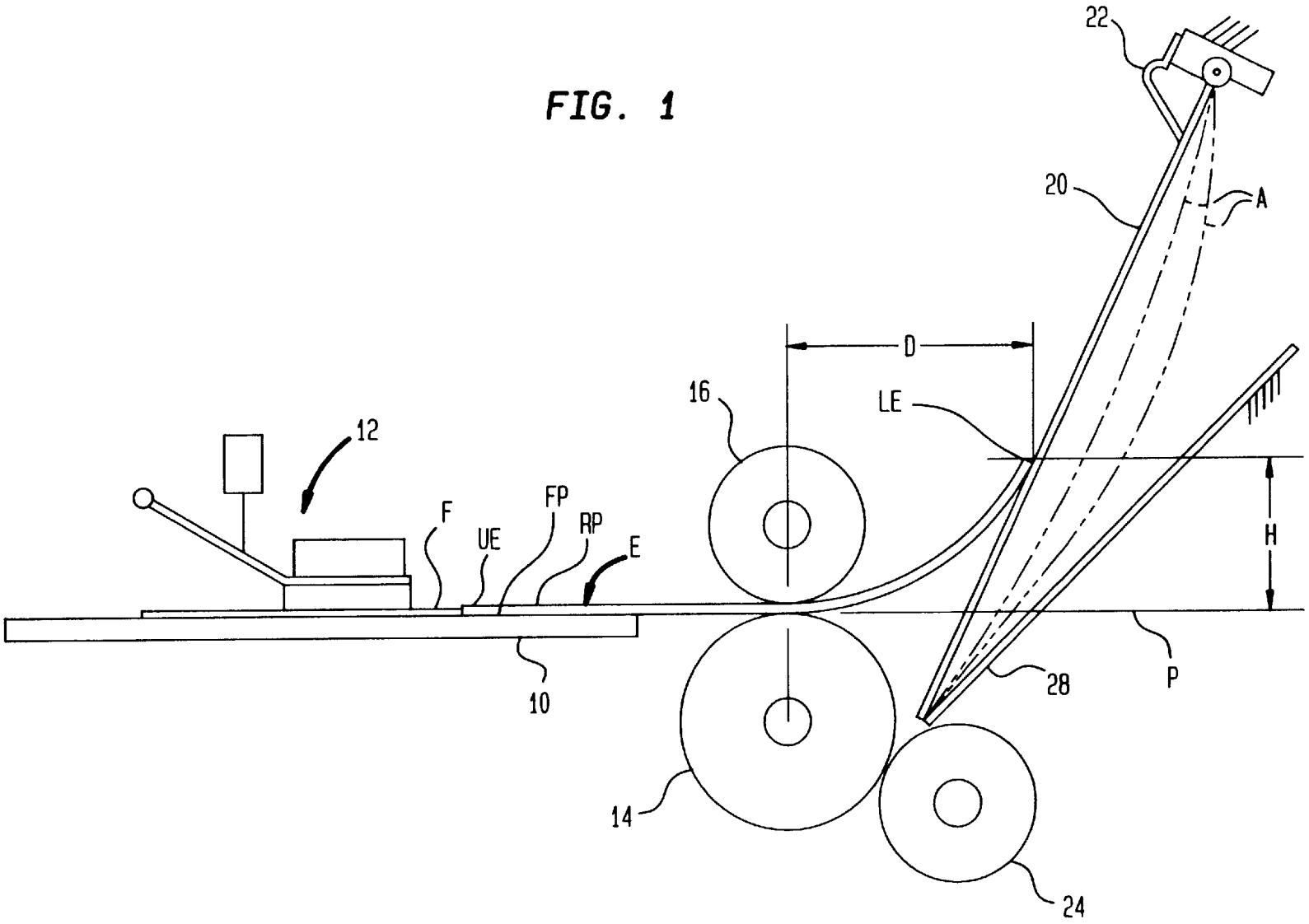
FIG. 1 is a semi-schematic side view of a mechanism in accordance with the subject invention showing deflection of an envelope.

FIG. 1 shows a side view of a preferred embodiment of the subject invention wherein a fixed table T defines a horizontal path P. An envelope E comprising a front panel FP and a rear panel RP joined at a lower edge LE, and not joined at an upper edge UE, and including a flap F connected to rear panel RP at upper edge UE, is positioned on table 10 in any convenient manner with panel FP adjacent to path P and lower edge LE forward.

A conventional moistening apparatus 12 is provided to moisten the adhesive which is applied in a conventional manner to the upper surface of flap F. Moistener 12 is conventional and forms no part of the subject invention other than to moisten adhesive on flap F so that flap F will remain sealed when folded against rear panel RP, as will be described further below. Alternatively, envelope E may include a self-adhesive which does not need moistening or flap F may be sealed by pressure, or heat or any other convenient technique.

As envelope E is moved along path P lower edge LE is captured in the nip of rollers 14 and 16 which apply a frictional force to envelope E to move it further along path P. Preferably roller 14 is formed from a compliant material, such as urethane foam, to allow roller 14 to conform to thicken envelopes.

As envelope E moves along path P lower edge LE encounters deflecting element 20. Element 20 is a substantially straight extended, planar element having a first end fixed, preferably rotatably fixed, adjacent to resilient stop 22 and a second end positioned below path P and adjacent nip of rollers 14 and 24 by fixed guide 28. As will be described further below, deflecting element 20 is formed of a resilient material such as resilient steel or plastic sheet. When envelope E contacts element 20, element 20 will deflect into the form of an arc illustrated by dotted lines A in FIG. 1. The deflection of element 20 is controlled by the position in which the first end is fixed, the movement of the second end of element 20 along guide 28 and the stiffness of envelope E. In FIG. 1 envelope E is shown as a relatively thin, less stiff envelope which produces little or no deflection in element 20. Thus lower edge LE has moved a distance D from the nip of rollers 14 and 16 by the time it has been deflected on amount H.

Figure 2:
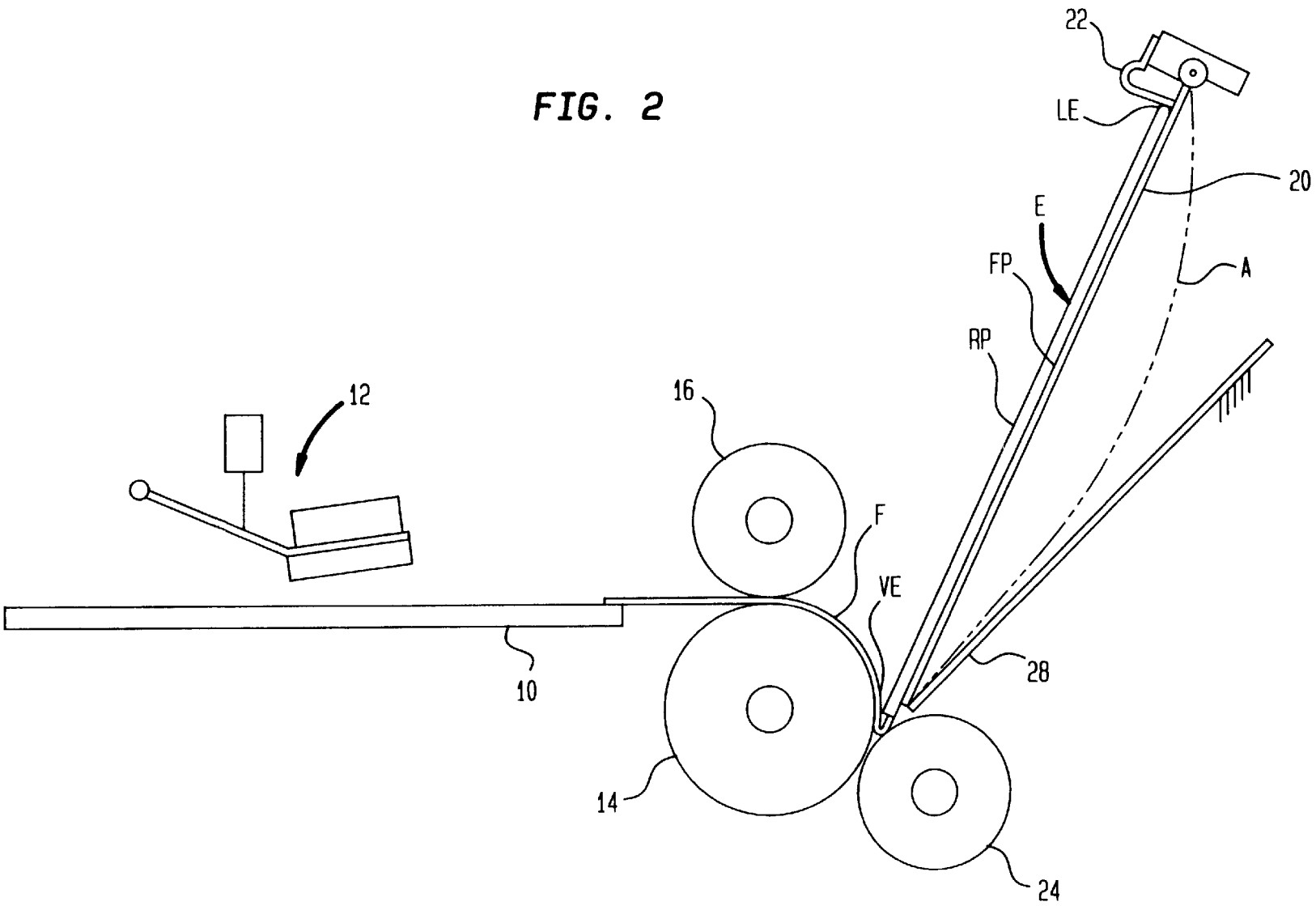
FIG. 2 is a semi-schematic side view of the same embodiment showing the envelope flap being folded and sealed against the rear panel in accordance with the subject invention.

FIG. 2 shows the further operation of the embodiment of FIG. 1 in folding and sealing flap F against rear panel RP. Rollers 14 and 16 continue to drive envelope E along element 20 until lower edge LE engages resilient stop 22. Stop 22 applies a retrograde force to envelope E.

Details of the design of resilient stop 22 are not critical to the subject invention; the only substantial requirements being that stop 22 have sufficient travel to accommodate the full range of widths (i.e. the distance from lower edge LE to upper edge UE) and that the retrograde force not be greater than the force applied by rollers 14 and 16 so that envelope E continues to move along element 20 until that force ceases.

Rollers 14 and 16 continue to drive envelope E against stop 22 until upper edge UE clears the nip of rollers 14 and 16. Then rollers 14 and 16 will be in contact with flap F which lacks sufficient stiffness to couple any substantial force to envelope E. This decoupling of rollers 14 and 16 from envelope E is enhanced since envelope E is normally creased along upper edge UE where flap F joins rear panel RP.

When the force of rollers 14 and 16 is decoupled from envelope E it begins to move backwards towards the nip of rollers 14 and 24 under the influence of retrograde force applied by resilient stop 22. At the same time any deflection in element 20 will relax and the second end of element 20 will be guided back to its original position adjacent to the nip of rollers 14 and 24. Thus element 20 returns to its original, nominal position and becomes a straight guide which supports, aligns and guides envelope E so that upper edge UE is captured by the nip of rollers 14 and 24 folding and sealing flap F against rear panel RP.

Figure 3:
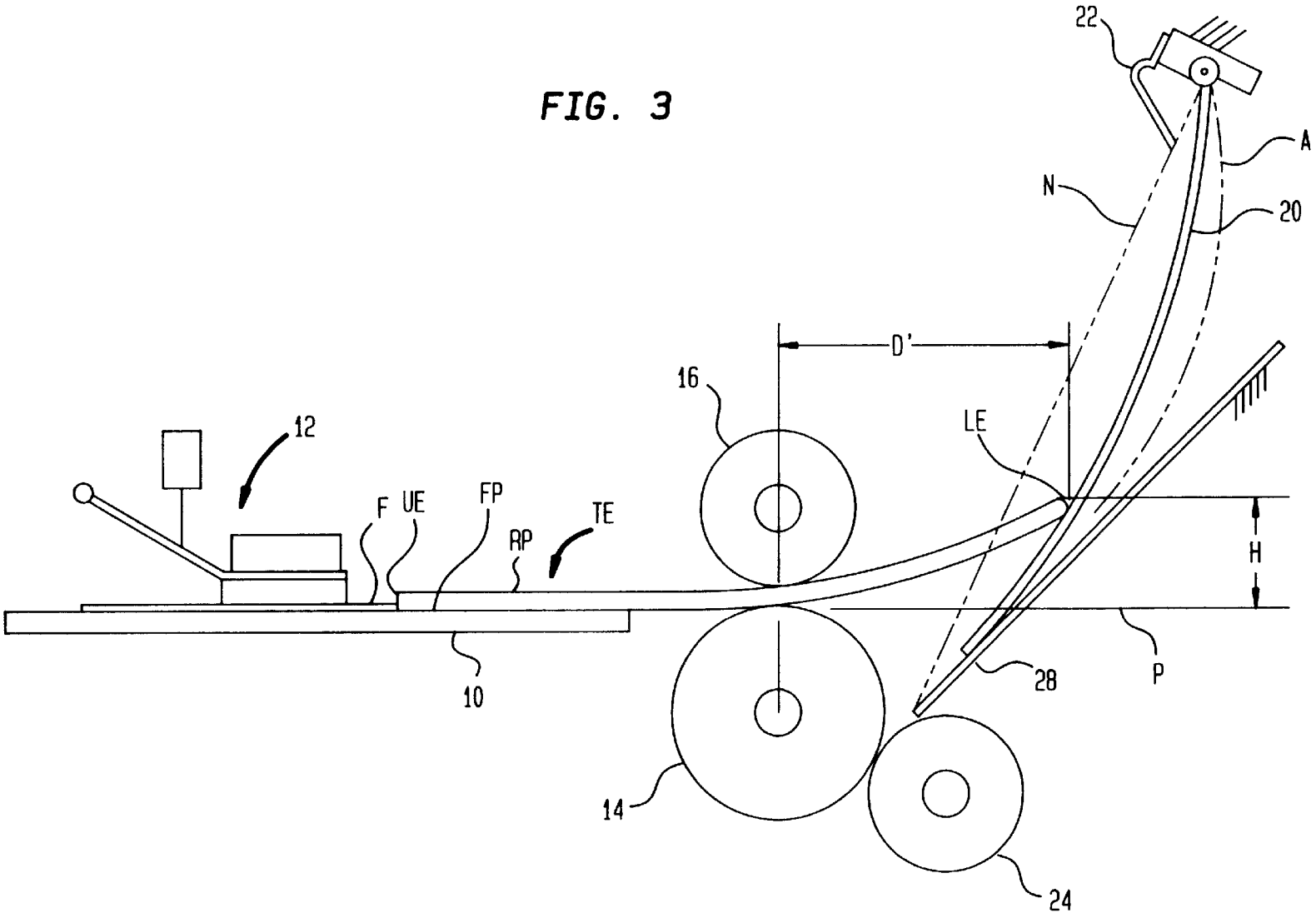
FIG. 3 is a semi-schematic side view of the same embodiment of the subject invention showing deflection of a thicker and stiffer envelope.

FIG. 3 shows the embodiment of FIGS. 1 and 2 operating upon a relatively thick, stiff envelope TE. Envelope TE has the same configuration as envelope E and includes front panel FP rear panel RE flap F, lower edge LE, and upper edge UE.

As envelope TE contacts deflecting element 20 its greater stiffness causes element 20 to deflect from the nominal straight position N as shown in FIG. 3. Yet stiffer envelopes would cause element 20 to deflect to the arc shown by line A or further.

Note that thick guide 28 constrains the second end of element 20 so that envelope TE does not simply push element 20 aside, yet allows a degree of freedom so that the second end of element 20 is free to move along the upper surface of thick guide 28 as element 20 deflects in contact with envelope TE. In the limiting case fix guide 28 assures that even the stiffest envelopes will be deflected.

The design of element 20 is not critical. Element 20 need only have sufficient resilience to assure that it will return to its nominal position N when the force of rollers 14 and 16 is decoupled from envelope E as upper edge UE passes through the nip of rollers 14 and 16; typically less 1 lb. of force applied per inch of deflection, so that the possibility of buckling thicker envelopes is reduced or eliminated. The upper limit on the resilient force which may be applied to envelope E through element 20 is the need to assure that even the least stiff envelope will deflect element 20 before element 20 buckles the envelope.

Support 20 is positioned, in the relaxed state, parallel or slightly intrusive to the tangent through the nip of rollers 14 and 24 with its second end proximate to the nip so that envelope is supported and guided substantially along its full width as it is captured by the nip.

Dimensioning of the embodiment shown in FIGS. 1–3 is not critical except that, as noted above the range of travel of resilient stop 22 should accommodate the full range of envelope widths anticipate and details of a design in accordance with the embodiment showing FIGS. 1–3 may readily be determined from knowledge of this range.

Within these broad constraints satisfactory performance over a wide range of envelope thicknesses and stiffness may be achieved in the subject invention using the above identified materials to form element 20.

Consideration of FIG. 3 shows that by the time that envelope TE has been deflected by an amount H it has traveled and increased distance D' from the nip of rollers 14 and 16. This increased distance (i.e. decreased rate of deflection) assures that the deflecting forces applied to envelope TE remain low enough that envelope TE will not buckle.

After envelopes E or TE pass through the nip of rollers 14 and 24 they are conveyed away for further processing for distribution in any convenient manner, which forms no part of the subject invention.

The above description of preferred embodiments of the subject invention has been provided by way of illustration only, and those skilled in the art will appreciate numerous other embodiments of the subject invention form consideration of the above description and the attached drawings. Accordingly, limitations on the claimed invention are to be found only in the claims set forth below.

What is claimed is:

1. A mechanism for sealing an envelope, said envelope having front and rear panels, said panels being joined along a lower edge and not joined along an upper edge, and having a sealable flap joined to said front panel along said upper edge, said mechanism comprising:

a) a first means for moving said envelope along a path, said envelope being oriented with said lower edge forward, said front panel proximate to said path, and said flap open;

b) a second means for capturing said upper edge as it clears said first means and for folding and sealing said flap against said rear panel, said second means having an intake proximate to said path for receiving said upper edge;

c) stop means displaced from said path for engaging said lower edge and urging said upper edge towards said intake; and, d) resilient deflecting means for deflecting said lower edge towards said stop means at a variable rate of deflection, said rate of deflection varying inversely with the stiffness of said envelope to prevent buckling of said envelope:

wherein said first and second means comprise first and second pairs of rollers, respectively;

wherein said intake comprises the nip of said second pair of rollers;

wherein said resilient deflecting means comprises a substantially straight extended element formed from a resilient material and having a first end fixed proximate to said stop means and a second end positioned proximate to said nip, said element deflecting in response to contact with said envelope to reduce the rate at which said lower edge is deflected sufficiently so that said envelope does not buckle.

2. A mechanism as described in claim 1, further comprising fixed means for guiding said second end as said resilient deflecting means responds to contact with said envelope.

* * * * *